US005634854A

United States Patent [19]

Albertsson

[11] Patent Number: 5,634,854

[45] Date of Patent: Jun. 3, 1997

[54] GOLF SWING TRAINING DEVICE AND METHOD

[76] Inventor: Peter S. Albertsson, R.R. 1, Box 1821, Pawlet, Vt. 05761

[21] Appl. No.: 618,299

[22] Filed: Mar. 18, 1996

Related U.S. Application Data

[63] Continuation-in-part of Ser. No. 487,510, Jun. 7, 1995, Pat. No. 5,499,820.

[51] Int. Cl.[6] ..... A63B 69/36

[52] U.S. Cl. ..... 473/213; 273/DIG. 30; 128/879

[58] Field of Search ..... 473/212, 213, 473/214; 273/DIG. 30; 128/879

[56] References Cited

U.S. PATENT DOCUMENTS

| | | | |
|---|---|---|---|
| D. 234,434 | 3/1975 | Trevino | D34/5 |
| D. 266,345 | 9/1982 | Bigham et al. | D21/234 |
| D. 274,386 | 6/1984 | Tanaka | D2/361 |
| D. 329,678 | 9/1992 | Mehrholz | D21/234 |
| 1,418,637 | 6/1922 | Flood | 273/189 A |
| 1,469,315 | 10/1923 | Hansard | 273/189 A |
| 2,794,638 | 6/1957 | Risher et al. | 273/54 |
| 3,235,258 | 2/1966 | Stroburg | 273/54 |
| 3,408,077 | 10/1968 | Norwood | 273/189 |
| 3,423,095 | 1/1969 | Cox | 273/189 |
| 3,606,342 | 9/1971 | Albertson, Jr. | 273/189 R |
| 4,088,318 | 5/1978 | Massman | 473/213 X |
| 4,241,922 | 12/1980 | Elliott, Jr. | 273/189 A |
| 4,292,963 | 10/1981 | Ford | 128/87 R |
| 4,451,044 | 5/1984 | Elliott | 273/189 A |
| 4,768,502 | 9/1988 | Lee | 128/87 R |
| 4,798,199 | 1/1989 | Hubbard et al. | 128/87 R |
| 4,925,187 | 5/1990 | Fleenor et al. | 273/54 B |
| 4,941,460 | 7/1990 | Working | 128/77 |
| 5,207,430 | 5/1993 | Goins | 273/189 R |
| 5,295,948 | 3/1994 | Gray | 602/5 |
| 5,425,539 | 6/1995 | Steffes | 273/189 A |
| 5,499,820 | 3/1996 | Abertsson | 473/213 |

*Primary Examiner*—George J. Marlo
*Attorney, Agent, or Firm*—Fisher, Christen & Sabol

[57] ABSTRACT

A device worn by a golf player around his following hand, wrist and lower forearm to aid in the proper hand placement for a proper golf swing. When worn, the device positions the following hand to promote a following club or racquet swing, yet allows the release of the following wrist. The golf swing trainer includes a rigid brace which has an inner side and an outer side and two or three straps attached to the outer surface of the rigid brace. The rigid brace is contoured so that a golfer's following hand is in the angle which is created when a golf club is swung with the club head following the turning body. The first and third straps are made of a non-resilient material and the second strap, which is in between the first strap and the third strap, is made of a resilient material. There is an angle adjustment system included with the device. It is a system of removable spacer pads which are used in combination to create a variety of present angles for the device. The removable spacer pads are located between the device and the lower forearm and are attached to the device by either a pressure sensitive adhesive or hook and loop fastening method. The pads are located under the brace at the lower forearm, and the stack of pads adjusts the angle.

30 Claims, 6 Drawing Sheets

FIG. 6
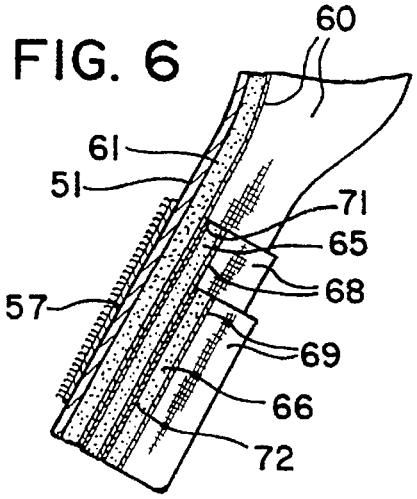
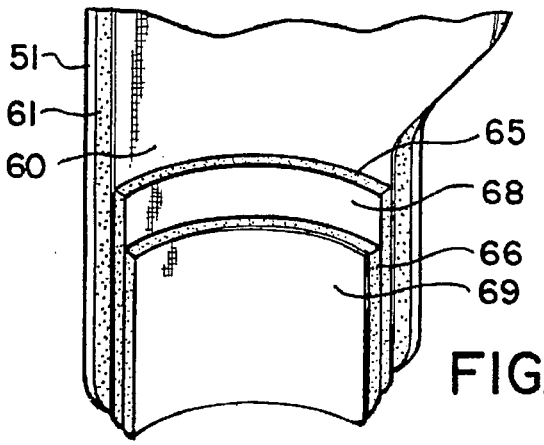
FIG. 7
FIG. 8
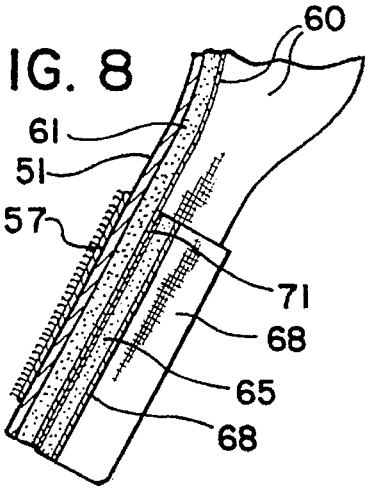
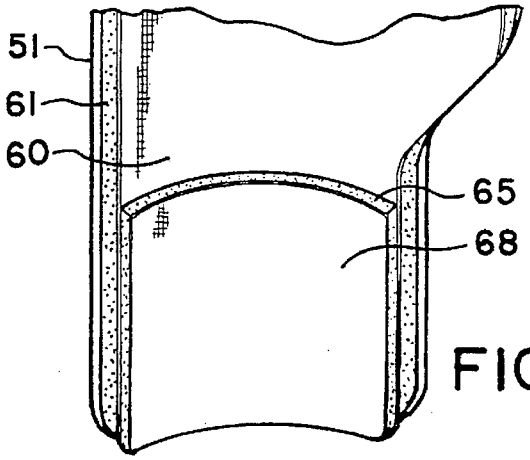
FIG. 9
FIG. 10
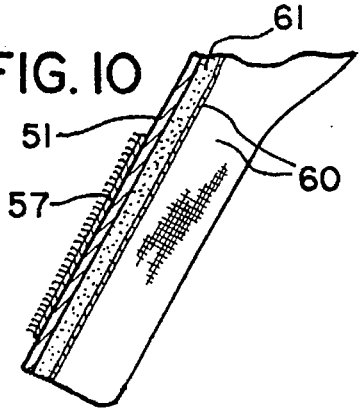
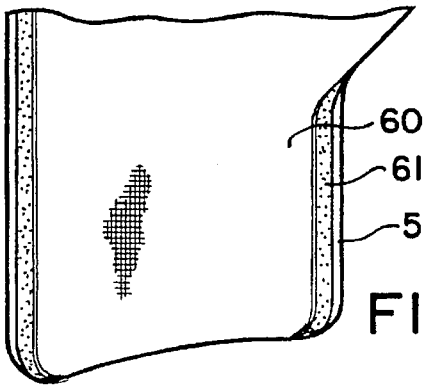
FIG. 11

GOLF SWING TRAINING DEVICE AND METHOD

This is a continuation-in-part of application Ser. No. 08/487,510, filed on Jun. 7, 1995, now U.S. Pat. No. 5,499,820.

BACKGROUND OF THE INVENTION

1. Field of the Invention

The invention relates to a golf training aid and, in particular, to a golf swing trainer. That is, the invention is an improved device worn by a player on the back side of his hand (including his index finger), wrist and lower forearm which aids in the proper placement of his hand and wrist for a proper golf swing. The improved device includes one or more removable spacer pads which allow the user to alter either or both the angle of the hand on which the device is worn or/and the range of motion during the swing, while maintaining continuous contact between the device and the hand, wrist and lower forearm when the user is not swinging the golf club (that is, when the user is addressing the golf ball).

2. Description of Related Art

Prior art golf swing trainers include the device which is illustrated in FIG. 1 of this application. The device of FIG. 1 includes a rigid or substantially rigid plastic brace which is molded so that a golfer's following hand (i.e., the right hand for a right handed golfer or the left for a left handed golfer) is in the angle which is created when the golf club is swung with the club head following the turning body. While making a golf stroke in this position, the driving power is applied in a straight line, in the direction of the desired line of flight. So-called "sliced strokes" and "short balls" are, thus, prevented to a substantial extent. It should be noted that it is common for a golfer to collapse his wrist in a backwards direction while swinging his golf club, which results in a line of driving power which is not straight. However, although the prior art device illustrated in FIG. 1 remedies this problem, when a golfer wears the device shown in FIG. 1, his index finger, hand, wrist and lower forearm are fixed in this position (by means of non-resilient or non-elastic straps 52 and 53 positioned as shown in FIG. 1).

Other golf training aids include those disclosed and claimed in U.S. Design Pat. No. 234,434 (Trevino), U.S. Design Pat. No. 266,345 (Bigham et al.), U.S. Design Pat. No. 329,678 (Mehrholz), U.S. Pat. No. 1,418,637 (Flood), U.S. Pat. No. 1,469,315 (Hansard), U.S. Pat. No. 3,408,077 (Norwood), U.S. Pat. No. 3,423,095 (Cox), U.S. Pat. No. 3,606,342 (Albertson, Jr.) and U.S. Pat. No. 4,241,922 (Elliott, Jr.). Other wrist support devices (for, for example, bowling or therapeutic purposes) include those disclosed and claimed in U.S. Design Pat. No. 274,386 (Tanaka), U.S. Pat. No. 2,794,638 (Risher et al.), U.S. Pat. No. 3,235,258 (Stroburg), U.S. Pat. No. 4,292,963 (Ford), U.S. Pat. No. 4,768,502 (Lee), U.S. Pat. No. 4,941,460 (Working), U.S. Pat. No. 4,925,187 (Fleenor et al.) and U.S. Pat. No. 5,295,948 (Gray). See also U.S. Pat. No. 4,451,044 (Elliott), U.S. Pat. No. 5,207,430 (Goins) and U.S. Pat. No. 5,425,539 (Steffes).

BROAD DESCRIPTION OF THE INVENTION

An object of the invention is to overcome the disadvantages and problems of the prior art golf swing trainers, including, in particular, those of the prior art golf swing trainer which is illustrated in FIG. 1. An object of the invention is to provide a golf swing trainer which prevents the backward collapse of a golfer's wrist during a golf swing, while still allowing for some mobility of the golfer's wrist at its bend point. Another object of the invention is to provide a golf swing trainer which allows the user to alter either or both the angle of the hand on which the device is worn or/and the range of motion during the swing, while maintaining continuous contact between the device and the hand, wrist and lower forearm when the user is not swinging the golf club (that is, when the user is addressing the golf ball). Other objects and advantages of the invention are set out herein or are obvious herefrom to one skilled in the art.

The objects and advantages of the invention are achieved by the golf swing trainer of the invention.

The invention disclosed in parent application Ser. No. 08/487,510 and herein includes a brace which is attached to the top or back surface of a golfer's hand, wrist and foream and which is contoured so that a golfer's following hand is in the angle which is created when the golf club is swung with the club head following the turning body. When the brace is in place, the hand is bent at an upward angle in relation to the longitudinal axis of the forearm. Or, in other words, the portion of the brace which fits against the hand is at an angle to the longitudinal axis of the portion of the brace which fits against the lower forearm.

When worn without any spacer pads, the device positions the following hand to promote a following club or racquet swing, yet allows the release or flex of the following wrist. This version uses three straps, the positioning of each of which is shown in FIG. 15 (but the spacer pads are not part of this version of the invention).

In another version, one or more spacer pads can be added to reduce the angle. (In general, the angle is smaller with the addition of each spacer pad.) This is important because different types of golf shots require different initial starting positions. The spacer pads are positioned on the inside of the back portion of the brace and contact the lower forearm of the user. Since the spacer pads may be removable, a golfer can change the number of spacer pads on the device between shots. Also, there may be considerable variation in any given position type between any two individuals. For example, when putting a ball, one golfer may prefer a larger angle than would another golfer. The ability to add one or more spacer pads allows an individual to change the angle or range of motion, in accordance with his preference, ability, type of shot, etc. The spacer pads, then, allow the individual to customize the fit and function of the instant golf training aid. This version uses two straps, as shown in FIG. 2, or three straps, as shown in FIG. 15.

Attached to the brace may be padding and an outer layer of material over this padding. The padding may make the brace more comfortable to wear.

Two or three straps hold the player's hand, wrist and lower forearm against the brace, when spacer pads are used. The first (front) strap encircles the golfer's index finger or forefinger on his following hand. This first strap is not made of resilient material. The second (back) strap encircles the player's lower forearm above his wrist. This second strap is made of a stretchable, resilient material, so that some bending movement of the player's wrist at its bend point is possible. The third (middle) strap encircles the golfer's foream directly above the bend point on his wrist. This third strap is positioned between the other two straps. All of the two or three straps are attached to the back of the brace.

The invention device addresses and substantially solves the problem of a golfer collapsing his wrist in a backwards direction while swinging his golf club, which results in a line of driving power which is not straight. Both the prior art device illustrated in FIG. 1 and the subject invention remedy this problem. However, when a golfer wears the prior art device shown in FIG. 1, his index finger, hand, wrist and lower forearm are fixed in this position. This position should not be completely fixed in the golf swing. Some bending movement of the following wrist is necessary for full swings. In contrast, in the instant invention, the second (back) strap is made of resilient material and, thus, allows for a bending point in a golfer's wrist. The second (back) strap stretches, so a golfer's foream can move (flex) slightly in relation to the golfer's hand during the swing or putt. The particular angle which is created when the golf club is swung with the club head following the turning body can be made smaller by the addition of one or more spacer pads.

The instant invention encompasses a right handed brace or a left handed brace, either of which can be used by right handed or left handed players. The brace shown in FIGS. 2 to 16 is a right handed brace. If the player is right handed, the right handed brace is secured to the golfer's right index finger, hand, wrist and lower forearm. Similarly, if the player is left handed, the right handed brace is secured to the golfer's left index finger, hand, wrist and lower forearm. The left handed brace which can be used by left handed or right handed players is a mirror image of the right handed brace and is shown in FIG. 17. In all other respects, the right handed brace and the left handed braces are identical to one another.

Preferably the removable spacer pads are composed of a foam neoprene layer with a nylon layer on one side of the foamed neoprene layer and with a pressure sensitive adhesive layer on the other side of the foamed neoprene layer.

Modifications and changes made to the golf swing trainer can be effected without departing from the scope or spirit of the present invention. For example, the rigid, molded base could be made of metal, as opposed to being made of a hard plastic. Or, for example, the spacer pad(s) could be made of a material other than the material of the preferred pad recited above. Also, the embodiments of this golf swing trainer, which are illustrated as follows, have been shown only by way of example and should not be taken to limit the scope of the following claims.

BRIEF DESCRIPTION OF THE DRAWINGS

In the drawings:

FIG. 6 is a side view of approximately one-third of the back of the improved golf training aid including both the VELCRO patch upon which the third strap is attached and two terraced removable spacer pads;

FIG. 7 is a bottom view in elevation of the back portion of the rigid brace including padding beneath the outer layer and two removable spacer pads, of FIG. 6;

FIG. 8 is a side view of approximately one-third of the back of the improved golf training aid including the VELCRO patch upon which the third strap is attached and one removable spacer pad;

FIG. 9 is a bottom view in elevation of the back portion of the rigid brace, including padding beneath the outer layer and a removable spacer pad, of FIG. 8;

FIG. 10 is a side view of approximately one-third of the back of the golf training aid including the VELCRO patch upon which the third strap is attached;

FIG. 11 is a bottom view in elevation of the back portion of the rigid brace, including padding beneath the outer layer, of FIG. 10;

DETAILED DESCRIPTION OF THE INVENTION

A rigid brace (51) is contoured to matingly engage the golfer's right index finger, hand, wrist and lower forearm. The brace (51) is anatomically shaped to fit the contours of the golfer's extended right index finger, hand, wrist and lower forearm while these body parts are positioned at the proper angle which is created when a golf club is swung with the club head following the turning body. While making a golf stroke in this position, the driving power is applied in a straight line, in the direction of the desired line of flight. While wearing the brace, the golfer is unable to collapse his wrist in a backwards direction. So-called "sliced strokes" and "short balls" are, thus, prevented.

Figure 13:
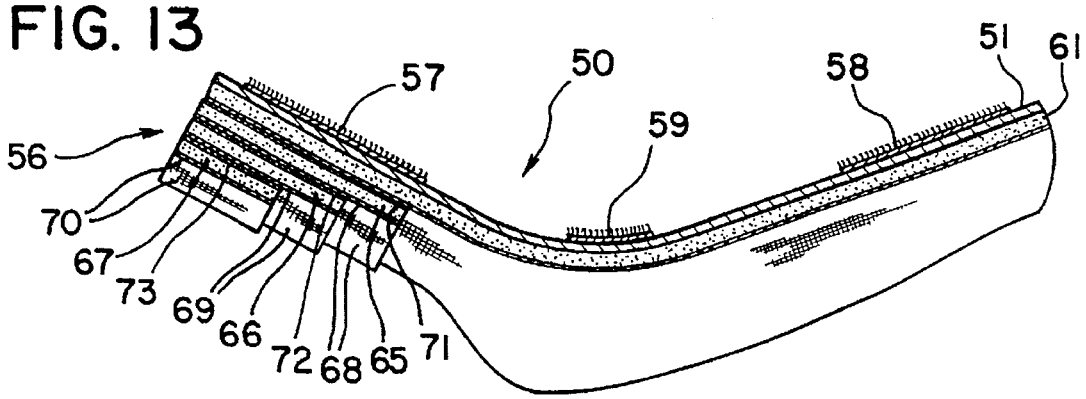
FIG. 13 is a right side view in elevation of the brace in inverted position, without the straps attached thereto and including three removable spacer pads, of FIG. 12.
Figure 14:
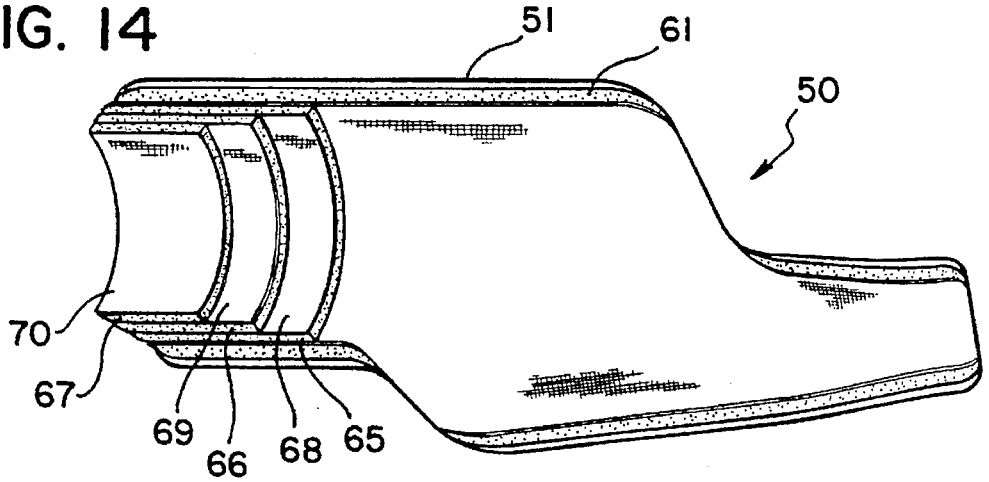
FIG. 14 is a bottom plan view of the top portion of the brace, including both the padding positioned thereon and three terraced removable spacer pads, of FIG. 12.
Figure 15:
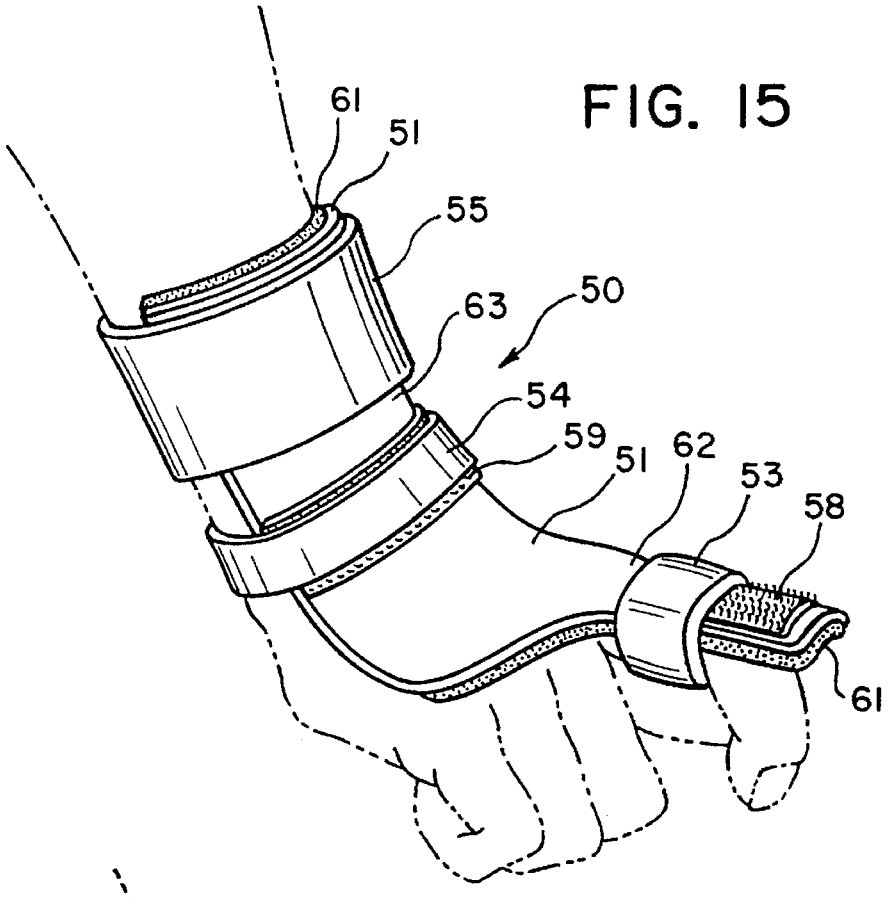
FIG. 15 is a perspective view of the improved golf training aid disclosed and claimed in parent application Ser. No. 08/487,510, filed on Jun. 7, 1995, positioned on a person's right hand and lower forearm.
Figure 16:
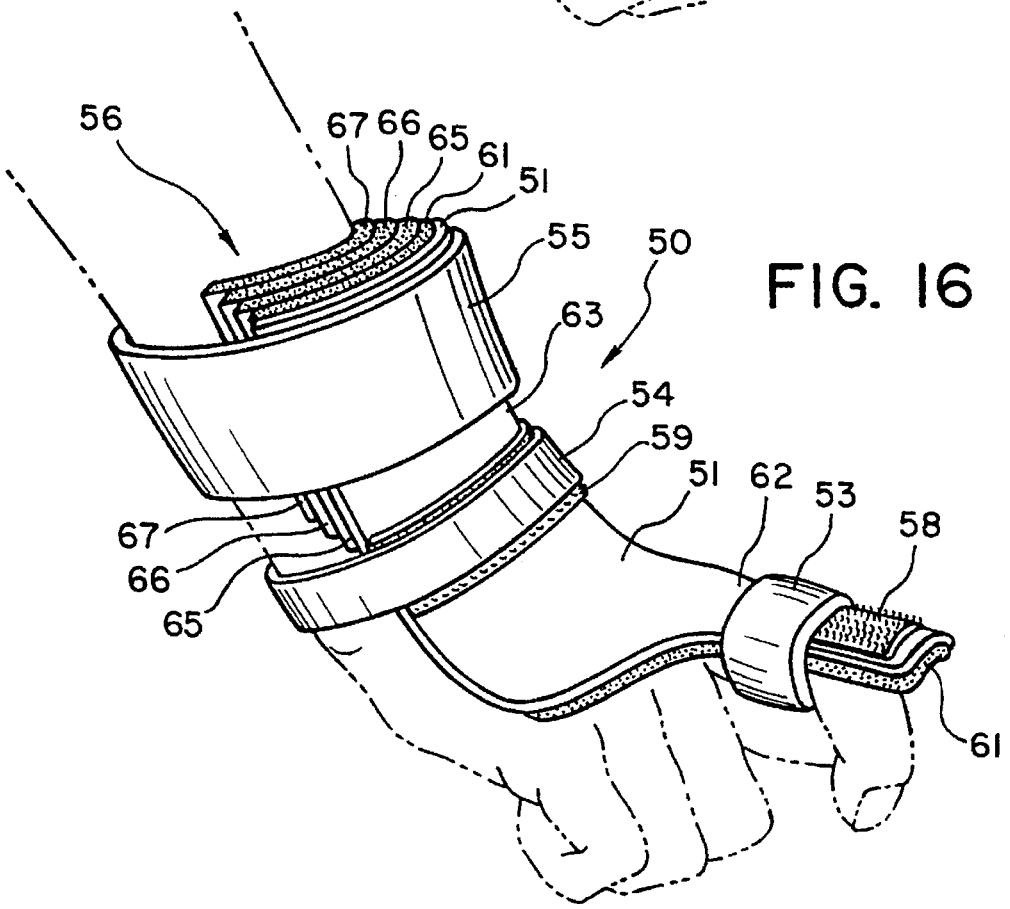
FIG. 16 is a perspective view of the improved golf training aid positioned on a person's right hand and lower forearm and including three terraced removable spacer pads.

When the brace (51) is in place, the hand is bent at an upward angle in relation to the longitudinal axis of the forearm. Or, in other words, the portion (62) of the brace (51) which fits against the hand is at an angle to the longitudinal axis of the portion (63) of the brace (51) which fits against the lower forearm. When no spacer pads have been added to the front portion of the rigid base, this angle is usually between about 35 and 55 degrees, preferably between about 40 and about 50 degrees, and most preferably about 45 degrees. The positioning of the brace (51) on the hand and the angle are illustrated in FIGS. 2, 3, 4, 15, 16 and 17 (the lattermost figure showing a left handed brace). The angle of the front portion (62) to the back portion (63) of the brace (51) is clearly illustrated in FIG. 13. FIG. 13 also illustrates how the brace can be modified with removable spacer pads to reduce the angle of the longitudinal axis of the forearm and the longitudinal axis of the hand/index finger. This reduction in angle is usually in the range of 5 to 20 degrees, particularly (preferably) 10 to 15 degrees, depending upon the needs of the particular user, and depending upon the number and thickness of the spacer pads used. The three spacer pads shown in FIG. 13 reduce the angle by about 10 to about 12 degrees.

Figure 1:
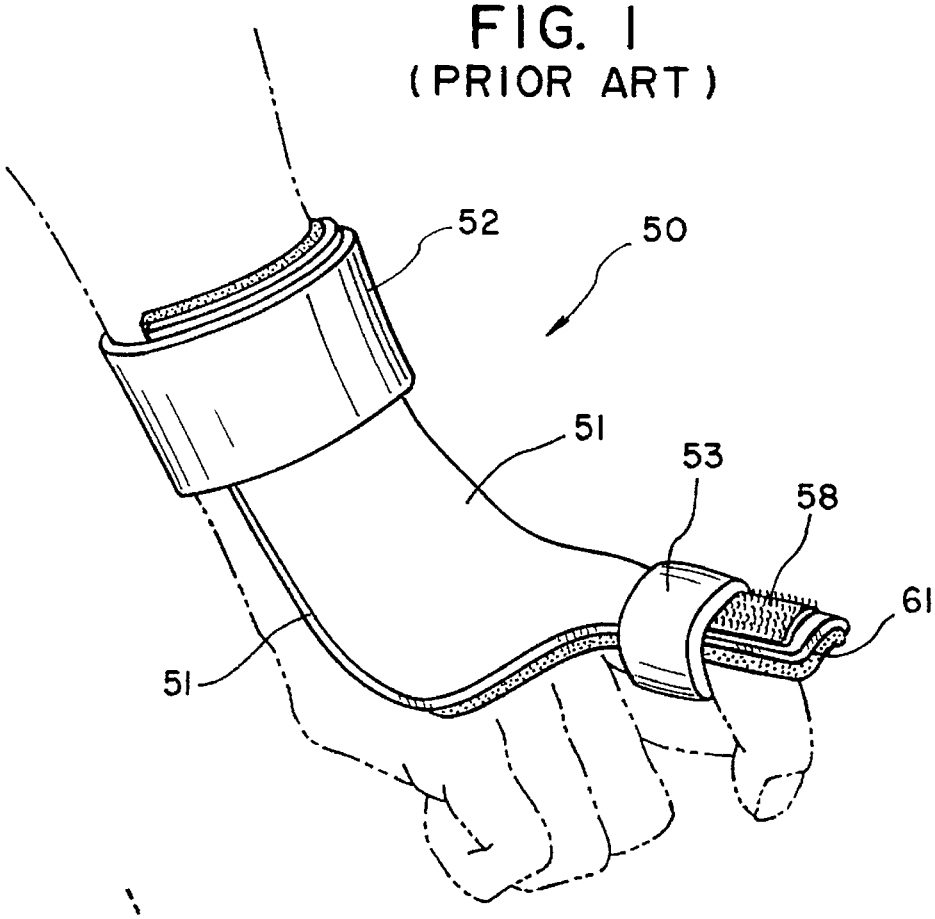
FIG. 1 (PRIOR ART)
FIG. 1 is a perspective view of the prior art golf training aid positioned on a person's right hand and lower forearm.
Figure 2:
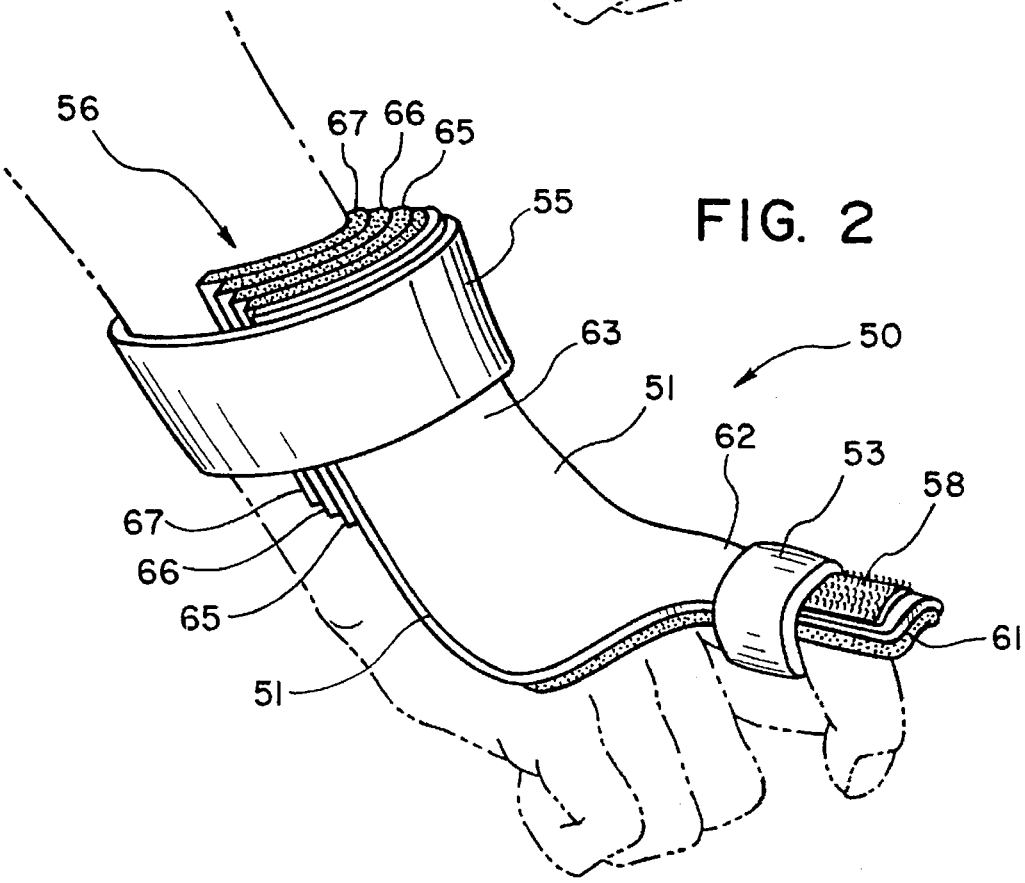
FIG. 2 is a perspective view of the improved golf training aid on a person's right hand and lower forearm including three terraced removable spacer pads but not including the second strap or the VELCRO patch upon which the second strap may be attached.
Figure 3:
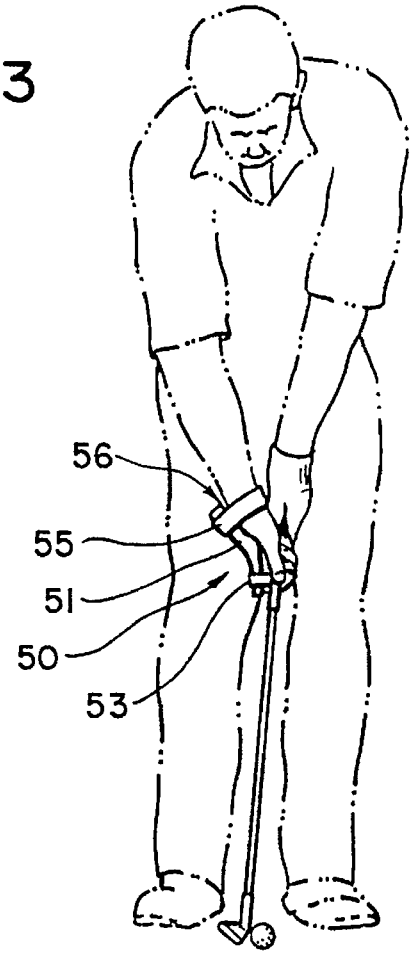
FIG. 3 is a perspective view of the improved golf training aid on a person holding a golf club in a putting position.
Figure 4:
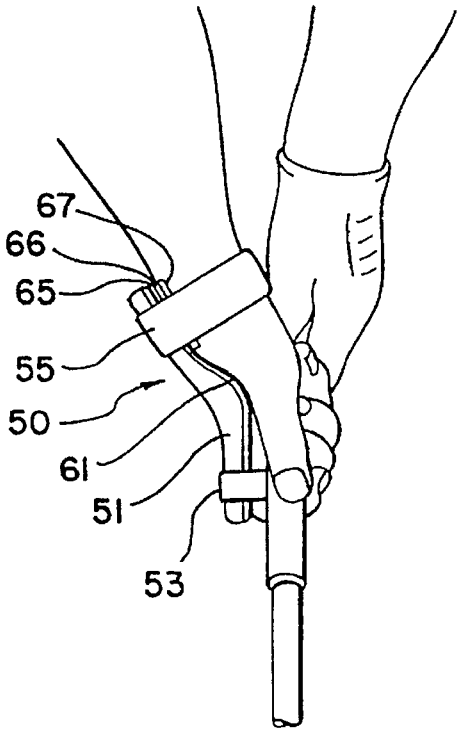
FIG. 4 is a perspective view of the improved golf training aid with three removable spacer pads on a person's right lower arm, forearm, wrist, hand and finger while the person is gripping a golf club in a putting or chipping position.

The brace (51) may be made of any appropriate, rigid (or substantially rigid) material which can be formed in the desired shape, and is preferably made of a hard, lightweight plastic. It is convenient to make the brace (51) by injection molding. The part of the brace (51) against which the golfer's index finger (of his following hand) rests is best wider than, and preferably about twice as wide as, his index finger. The part (62) of the brace (51) against which the back of the golfer's hand rests is preferably about as wide as is the back of his hand. The part of the brace (51) against which the back of the golfer's wrist rests and the lower end of the forearm fits is about the same thickness as part (62). Thus, the middle portion of the brace (51) is wider than is the portion of the brace (51) against which the golfer's index fingers rests. The part (63) of the brace (51) narrows down to a form which correlates to the top of the lower forearm, and has the same width as the lower portion of the forearm. The top outline of the brace (51) is best seen in FIG. 4.

Transverse cross-sections of the brace (51) show that the top surface thereof is convex and that the bottom surface thereof is concave.

A padding (61) preferably is attached (bonded) to and extends along the length of bottom surface of the brace (51) to cushion and support the golfer's index finger, hand, wrist and lower forearm. The padding (61) may be made of foam rubber (preferred) or of some other comfortable and appropriate material—foamed neoprene is preferred. An outer layer (60) of material (preferably woven cloth such as woven, standard nylon) may be attached (bonded) to the layer of padding.

Attachment means (53, 54 and 55) are provided for holding the brace (51) against the index finger, hand, wrist and lower forearm of the golfer's following arm. These attachment means are shown as three straps (53, 54 and 55) attached to the top of brace (51), that is, on the opposite side from where the padding (61) is attached. The attachment scheme preferably uses the conventional loop and hook material scheme. The attachment strips (57, 58 and 59) are affixed (bonded) transverse across the top surface of the brace (51). The attachment strips (57, 58, 59) are made of hook materials such as that which is sold under the trademark VELCRO. The straps (53, 54 and 55) are a woven pile fabric or a loop fabric (on both sides) whereby the center portion of each of the attachment straps (53, 54 and 55) is detachably affixed to the hook material comprising the strips (57, 58 and 59). The second strap (55) is attached to the top side of the brace (51) opposite to where the lower forearm of the golfer rests. The second strap preferably is made of resilient material such as a woven fabric composed of resilient or elastic polymeric fiber. One end of second strap (55) is made of a hook material (e.g., the material sold under the trademark VELCRO), or it may be made of other suitable material, so that the two ends of the strap may be detachably affixed to one another to form a loop. A buckle (not shown) may be attached to one end of the second strap (55) whereby the detachable affixing is done by looping through the buckle and then back on itself (loop and hook material attachment). The first strap (53) is attached to the top side of the brace (51) opposite to where the golfer's index finger rests. The first strap (53) is not made of resilient material. The first strap (53) is a shorter and narrower version of the second strap (55), and uses the same loop and hook (e.g., VELCRO) material scheme to form a loop to go around the index finger. The third strap (54) is attached to the top side of the brace (51), opposite to the area of the padding (61) on the golfer's forearm, just before the wrist. A buckle (not shown) may be attached to the end of the third strap (54). One end of the third strap (54) is made of a hook material (e.g., VELCRO), so that such end of the third strap (54) can be looped through the buckle and then back on itself for loop and hook detachable affixing. Each of the straps (53, 54, 55) are preferably releasably attached to a strip (57, 58, 59) of material sold under the trademark VELCRO or other resilient, contact fastening material attached to the brace (51) on the opposite side from where the padding (61) is attached.

One or more removable spacer pads [collectively designated (56)] can be secured to the inside of the back portion of the rigid base (51) where the second strap (55) is attached to the back portion of the rigid base (51).

Preferably, if more than one spacer pad (56) is present, the pads (65, 66) are arranged in a terraced position to one another as is shown in, for example, FIG. 7. In other words, the spacer pad (65) attached to the base extends further down the hand (towards the fingers) of the user than does the pad (66) which is attached to it, etc. This terraced positioning is best achieved by using two or more pads (56) having constant (and the same or similar) widths but varying lengths. This positioning of the pads (56) allows for continuous contact between the arm, forearm, hand and finger even where the pads (56) have allowed for a smaller (reduced) angle of the hand in relation to the longitudinal axis of the forearm. The spacer pads (56) need not be positioned in this terraced manner. FIGS. 6 and 7 show the use of a terraced arrangement of two spacer pads (65, 66); FIGS. 8 and 9 show one spacer pad (65); and FIGS. 10 and 11 illustrate the absence of any spacer pads.

The spacer pads (56) may be made of a foamed material, preferably neoprene manufactured by Rubitex (Model Number N 1400-N). The spacer pads may also have an outer woven or nonwoven material covering layer, preferably made of woven standard nylon. The spacer pads may be of different thicknesses or may have the same thickness, preferably 5/32 to 3/16 of an inch thick.

FIGS. 2, 12, 13 14 and 16 show the improved golf swing trainer (51) having three terraced, removable spacer pads (65, 66, 67).

Figure 5:
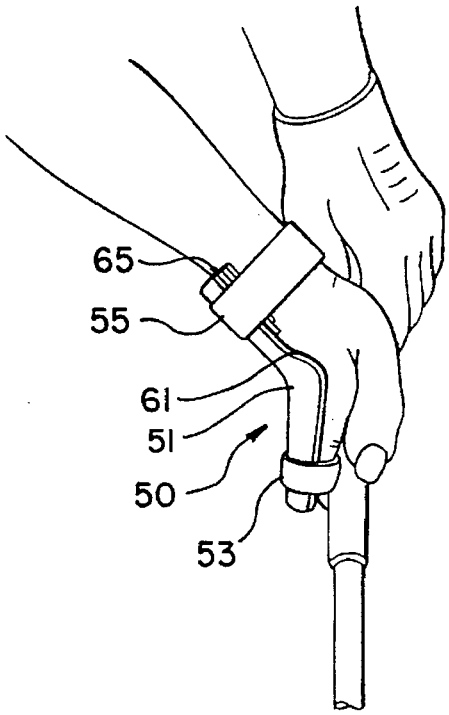
FIG. 5 is a perspective view of the improved golf training aid with three removable spacer pads on a person's right lower arm, forearm, wrist, hand and finger while the person is gripping a golf club in a different putting or chipping position or forearm angle than is shown in FIG. 4.
Figure 12:
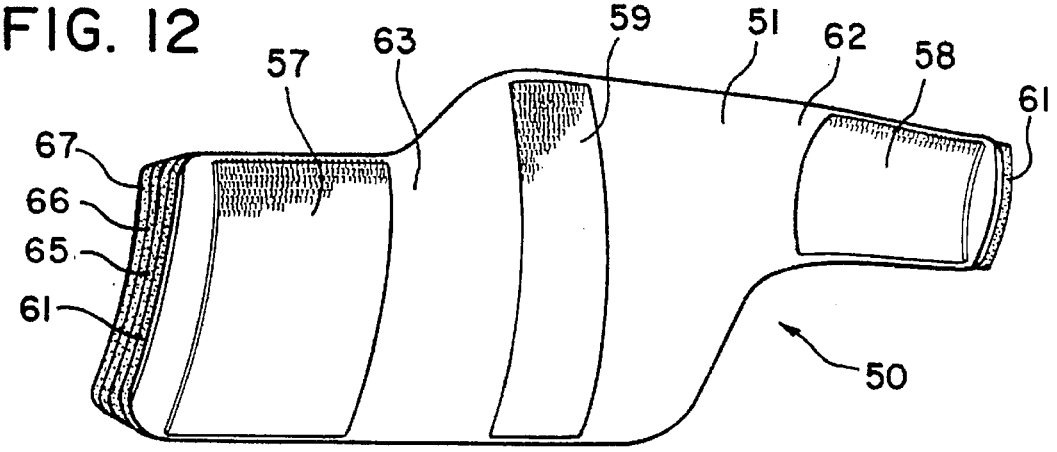
FIG. 12 is a top plan view of the back of the brace including both the three patches of material sold under the trademark VELCRO or other similar material and the three terraced removable spacer pads.

FIG. 5 shows the use of one removable spacer pad (65) (note the relatively wide angle of the forearm of the right hand to the club handle). FIG. 4 shows the use of three terraced spacer pads (65, 66, 67) (the angle of the forearm of the right hand to the club handle is less than in FIG. 5). These figures illustrate the effect that the use of differing numbers of spacer pads have on the right forearm and the grip.

The spacer pads (56) may be attached to the bottom of the base (51), or the padding (61), and to one another by a pressure (sensitive) adhesive. Or, they may be attached to the base (51) by a hook and look material [for example, a strip of VELCRO can be placed on the spacer pad (56) and a strip of loop material can be placed on the bottom of the rigid brace (51) where the spacer pad (56) will be attached or vice versa]. One or more spacer pads (56) can even be permanently affixed to the front of the rigid base (51), although this limits the ability of an individual to customize the angle as between different types of shots, for example, although one or more removable spacer pads (56) can still be added.

Usually, the index finger is inserted through the first strap (53), which is in looped form. Then, the second strap (55) is put into place and looped around the lower forearm. The first strap (53), then, is tightened. Then, the optional third strap (54) is put into place and looped around the lower forearm just before the wrist. Any other sequence can be used, of course, to attach the brace (51) for use by a golfer.

Figure 17:
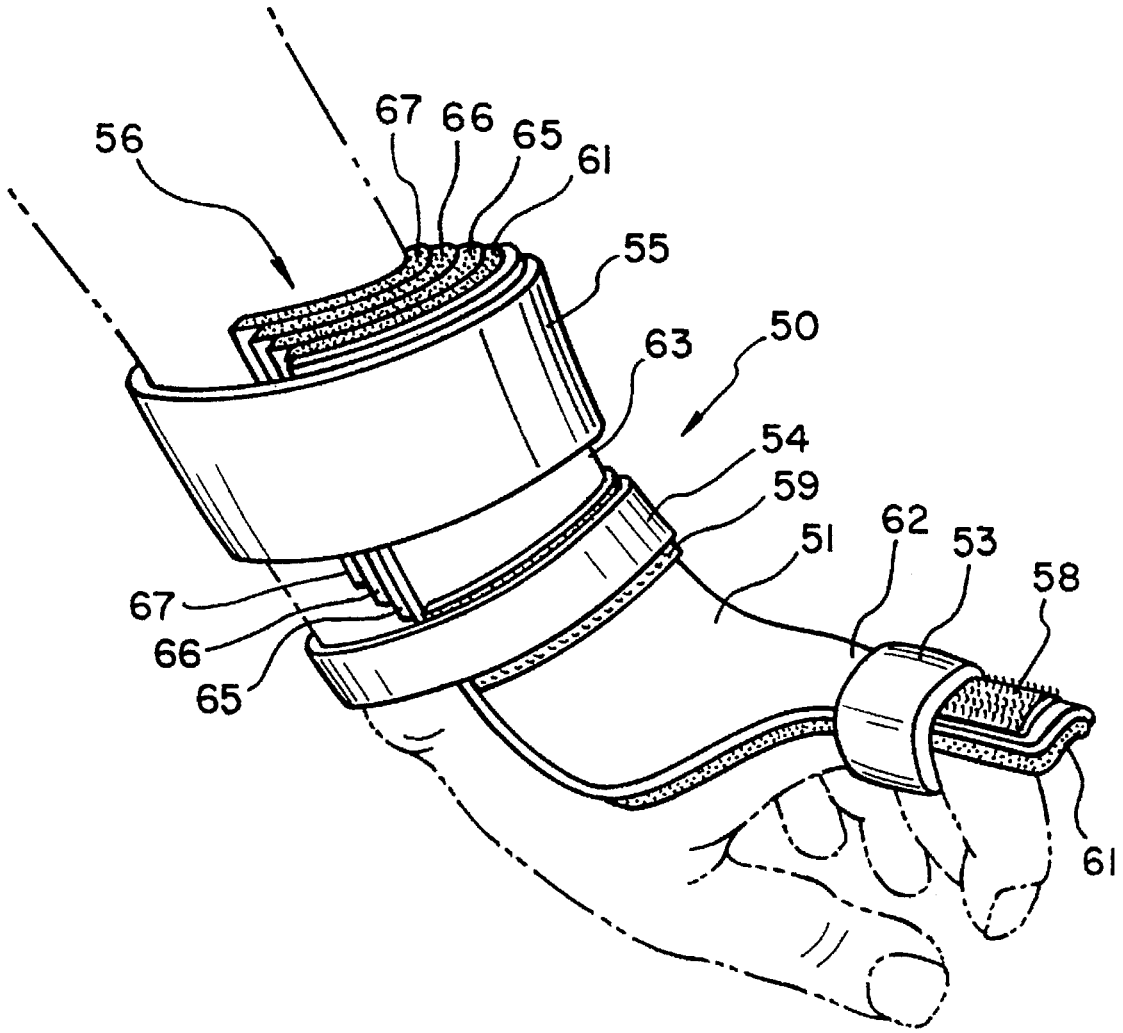
FIG. 17 is a perspective view of the improved golf training aid positioned on a person's left hand and lower forearm and including three terraced removable spacer pads.

The right handed brace (51) of the instant invention may be used by either right handed or left handed players. If the player is left handed, the brace (51) is secured to the golfer's left index finger, hand, wrist and lower forearm. Similarly, if the player is right handed, the brace (51) is secured to the golfer's right pointer (index) finger, hand, wrist and lower foream. The brace (51) shown in FIGS. 2 to 16 is a right handed brace (51). The left handed brace (51), which is to be used mainly by left handed players, is a mirror image of the right handed brace (51) to be used mainly by right handed players and is shown in FIG. 17. In all other respects, the right handed brace and the left handed brace (51) are identical to one another.

LIST OF PARTS NUMBERS

In connection with the figures, the following list of the numbers and names of the parts of the instant invention are noted:

| | |
|---|---|
| 50 | golf swing trainer; |
| 51 | rigid brace; |
| 52 | second strap on prior art device; |
| 53 | first strap; |
| 54 | third strap; |
| 55 | flexible second strap on invention device; |
| 57 | VELCRO patch upon which second strap is attached; |
| 58 | VELCRO patch upon which first strap is attached; |
| 59 | VELCRO patch upon which third strap is attached; |
| 60 | outer layer of rigid brace; |
| 61 | padding beneath outer layer; |
| 62 | front portion of rigid brace; |
| 63 | back portion of rigid brace; |
| 65 | first removable spacer pad; |
| 66 | second removable spacer pad; |
| 67 | third removable spacer pad; |
| 68 | outer layer of first spacer pad; |
| 69 | outer layer of second spacer pad; |
| 70 | outer layer of third spacer pad; |
| 71 | first adhesive layer; |
| 72 | second adhesive layer; and |
| 73 | third adhesive layer. |

What is claimed is:

1. A golf swing trainer, which comprises:

(a) a rigid or substantially rigid brace having an inner side and an outer side, said inside of said brace being adapted to conform to and having an angle which conforms to an angle being formed by the top surface of a hand, a wrist and the lower portion of a forearm when the wrist is flexed upwardly;

(b) a first strap attached to the outer surface of said brace, said first strap being adapted to circumscribe the index finger of the hand;

(c) a second strap attached to the outer surface of said brace, said second strap being adapted to circumscribe the lower forearm near an end of the brace opposite of the end to which the first strap is attached; and (d) means for adjusting the angle of the brace.

2. The golf swing trainer as claimed in claim 1, wherein the means for adjusting the angle of the brace is at least one removable spacer pad affixed to the inner side of an end region of the brace where the second strap is located.

3. The golf swing trainer as claimed in claim 2, wherein two to four removable spacer pads are present, arranged one on top of the other.

4. The golf swing trainer as claimed in claim 3, wherein each of the removable spacer pads is shorter than any other removable spacer pad that lies between it and the brace.

5. The golf swing trainer as claimed in claim 2, wherein the removable spacer pad has a pressure sensitive adhesive on one side.

6. The golf swing trainer as claimed in claim 5, wherein the removable spacer pad is made of foam rubber.

7. The golf swing trainer as claimed in claim 1, wherein the first strap is comprised of a non-resilient material, and the second strap is comprised of a resilient material.

8. The golf swing trainer as claimed in claim 1, wherein the said brace is contoured so that a golfer's following hand is in the angle which is created when a golf club is swung with the club head following the turning body.

9. The golf swing trainer as claimed in claim 1, further comprising padding having an inner side and an outer side, the outer side of the padding being attached to the inner side of said brace.

10. The golf swing trainer as claimed in claim 1, further comprising a thin outer layer of material attached to the inner side of the padding.

11. The golf swing trainer as claimed in claim 1, further comprising a buckle attached to the second strap.

12. The golf swing trainer as claimed in claim 1, wherein the padding between the outer layer and the rigid brace is made of foam rubber.

13. The golf swing trainer as claimed in claim 1, wherein the first strap is attached to the outer surface of said brace at one of its ends, and the second strap is attached to the outer surface of said brace at its opposite end.

14. The golf swing trainer as claimed in claim 1, wherein the first strap and the second strap are releasably attached to the outer surface of said brace.

15. The golf swing trainer as claimed in claim 1, wherein said brace is made of a hard plastic.

16. The golf swing trainer as claimed in claim 1, wherein the mating, overlapping portions of the two ends of the first strap and the second strap are comprised, at least in part of hook material in a loop and hook arrangement so that the two ends of each strap may be easily and detachably attached to one another.

17. The golf swing trainer as claimed in claim 1, wherein the second strap is comprised, at least in part, of an elastic material.

18. The golf swing trainer as claimed in claim 1, wherein the patches upon which the first strap and the second strap are attached to the outer side of the brace are comprised of hook material.

19. The golf swing trainer as claimed in claim 1, which further comprises a third strap attached to the outer surface of said brace, said third strap being adapted to circumscribe the forearm immediately next to the wrist.

20. The golf swing trainer as claimed in claim 19, wherein the third strap is comprised of a non-resilient material.

21. The golf swing trainer as claimed in claim 19, wherein the third strap is attached to the outer surface of said brace between the first strap and the second strap.

22. The golf swing trainer as claimed in claim 19, wherein the third strap is releasably attached to the outer surface of said brace.

23. The golf swing trainer as claimed in claim 19, wherein the mating, overlapping portions of the two ends of the third strap are comprised, at least in part, of hook material in a loop and hook arrangement so that the two ends of each strap may be easily and detachably attached to one another.

24. The golf swing trainer as claimed in claim 19, wherein a patch upon the third strap is attached to the outer side of the brace and is comprised of hook material.

25. The golf swing trainer as claimed in claim 19, wherein the means for adjusting the angle of the brace is at least one removable spacer pad affixed to the inner side of an end region of the brace where the second strap is located.

26. The golf swing trainer as claimed in claim 25, wherein two to four removable spacer pads are present, arranged one on top of the other.

27. The golf swing trainer as claimed in claim 26, wherein each of the removable spacer pads is shorter than any other removable spacer pad that lies between it and the brace.

28. The golf swing trainer as claimed in claim 25, wherein the removable spacer pad has a pressure sensitive adhesive on one side.

29. The golf swing trainer as claimed in claim 28, wherein the removable spacer pad is made of foam rubber.

30. A method for training a person to swing a golf club, comprising wearing the golf swing trainer of claim 1 while gripping a golf club.

* * * * *